United States Patent [19]

Dilgren et al.

[11] Patent Number: 4,532,993

[45] Date of Patent: Aug. 6, 1985

[54] SELECTIVE STEAM FOAM SOAK OIL RECOVERY PROCESS

[75] Inventors: Richard E. Dilgren, Houston, Tex.; Paul B. Ritter, Bakersfield, Calif.

[73] Assignee: Shell Oil Company, Houston, Tex.

[21] Appl. No.: 530,156

[22] Filed: Sep. 7, 1983

[51] Int. Cl.[3] ..... E21B 43/24

[52] U.S. Cl. ..... 166/303; 166/309

[58] Field of Search ..... 166/272, 303, 309

[56] References Cited

U.S. PATENT DOCUMENTS

| | | | |
|---|---|---|---|
| 3,412,793 | 11/1968 | Needham | 166/303 X |
| 3,455,392 | 7/1969 | Prats | 166/303 |
| 3,464,491 | 9/1969 | Froning | 166/272 X |
| 3,994,345 | 11/1976 | Needham | 166/303 |
| 4,068,717 | 1/1978 | Needham | 166/272 |
| 4,086,964 | 5/1978 | Dilgren et al. | 166/272 |
| 4,161,217 | 7/1979 | Dilgren et al. | 166/272 X |
| 4,393,937 | 7/1983 | Dilgren et al. | 166/272 |
| 4,445,573 | 5/1984 | McCaleb | 166/303 X |

*Primary Examiner*—George A. Suchfield

[57] ABSTRACT

In a steam soak oil recovery process in a heavy oil reservoir which is susceptible to gravity override, improved results are obtained by injecting the steam in the form of a steam-foam-forming mixture which has a chemical selectivity for being more mobile within the reservoir in contact with the reservoir oil than in the absence of that oil.

4 Claims, 6 Drawing Figures

SELECTIVE STEAM FOAM SOAK OIL RECOVERY PROCESS

BACKGROUND OF THE INVENTION

The present invention relates to a steam soak or cyclic steam stimulation (or huff and puff) process for recovering oil. More particularly, the invention relates to a process for increasing the oil-to-steam ratio in a steam soak operation in a relatively thick homogeneous reservoir which is susceptible to gravity override and contains substantially oil-desaturated zone in and above the portions of oil sand which are in fluid communication with the well.

Numerous patents have disclosed various uses of steam and surfactants in connection with steam soak oil recovery processes. For example, in 1966 U.S. Pat. No. 3,292,702 described a steam soak process in which aqueous surfactant was injected just before injecting steam in order to provide increased injectivity and more complete backflow of steam condensate. In 1967, U.S. Pat. No. 3,357,487 described a steam soak process in which a surfactant was injected "directly into the steam" for "increasing the sweep efficiency of the injected fluid" (Col. 3, lines 51–62). In 1968, U.S. Pat. No. 3,412,793 described a steam soak process which was said to "attain the known advantages of foam plugging of highly permeable earth strata, but additionally can control the length of time which those strata will remain plugged, so that they may again be subjected to steam drive or steam stimulation for any length of time desired." (Col. 2, lines 12–16); with the plugging being due to injecting a small amount of surface active agent directly into the steam line at the surface of the well. In 1976, U.S. Pat. No. 3,994,345 described a steam soak process in which "long shut-in periods for the well which may be for a period of about two weeks" (Col. 1, lines 58-60) are avoided by injecting steam then injecting "material which will cause to be formed in the formation a condensable foam blocking zone" (Col. 2, lines 5–7); such as a steam foam present in an amount and of a strength which is preferably sufficient to "block the passage of steam into the well until the steam has transferred to the formation substantially all of the heat" (Col. 4, lines 9–12). In 1978, Canadian Pat. No. 1,031,697 described a steam soak process for producing oil from a zone immediately underlying a gas cap by first plugging the gas cap with enough self-collapsing foam, e.g., a steam foam of the type described in U.S. Pat. No. 3,412,793, to keep steam from entering the plugged zone. In 1979, Canadian Pat. No. 1,057,648 described a process for increasing the backpressure of steam used in a steam soak process in which a thief zone is being plugged by steam foam of the type described in U.S. Pat. No. 3,412,793, by injecting alternating slugs of steam and surfactant to form the steam foam plug.

As far as applicants are aware, it appears that in steam soak processes in which a heavy viscous oil contains a substantially oil-desaturated zone that tends to contain, intake and/or retain significant amounts of steam and/or gas, the previously proposed methods for improving the efficiency of a steam soak operation were designed for plugging and blocking such a desaturated zone with a steam foam that is capable of preventing steam inflow or outflow until the foam collapses due to the cooling and condensing of the steam that forms the gas-phase of the foam.

SUMMARY OF THE INVENTION

The present invention relates to an improvement in an oil recovery process in which steam is cyclicly injected into and fluid is backflowed from a heavy oil reservoir which is susceptible to a gravity override that causes an oil layer to become adjacent to a gas or vapor-containing substantially oil-desaturated zone in which there is an undesirable intake and retention of the injected fluid within the desaturated zone. In the present process, the steam to be injected is premixed with surfactant components arranged to form a steam foam within the reservoir having physical and chemical properties such that it (a) is capable of being injected into the reservoir without plugging any portion of the reservoir at a pressure which exceeds that required for injecting steam but is less than the reservoir fracturing pressure and (b) is chemically weakened by contact with the reservoir oil so that it is more mobile in sand containing that oil than in sand which is substantially free of that oil. The surfactant-containing steam is injected into the reservoir at a rate slow enough to be conducive to displacing a front of the steam foam farther along the oil-containing edge portions of the oil-desaturated zone than along the central portion of that zone. And, fluid is backflowed from the reservoir at a time at which at least some steam remains uncondensed within the steam foam in the reservoir.

DESCRIPTION OF THE INVENTION

Figure 1:
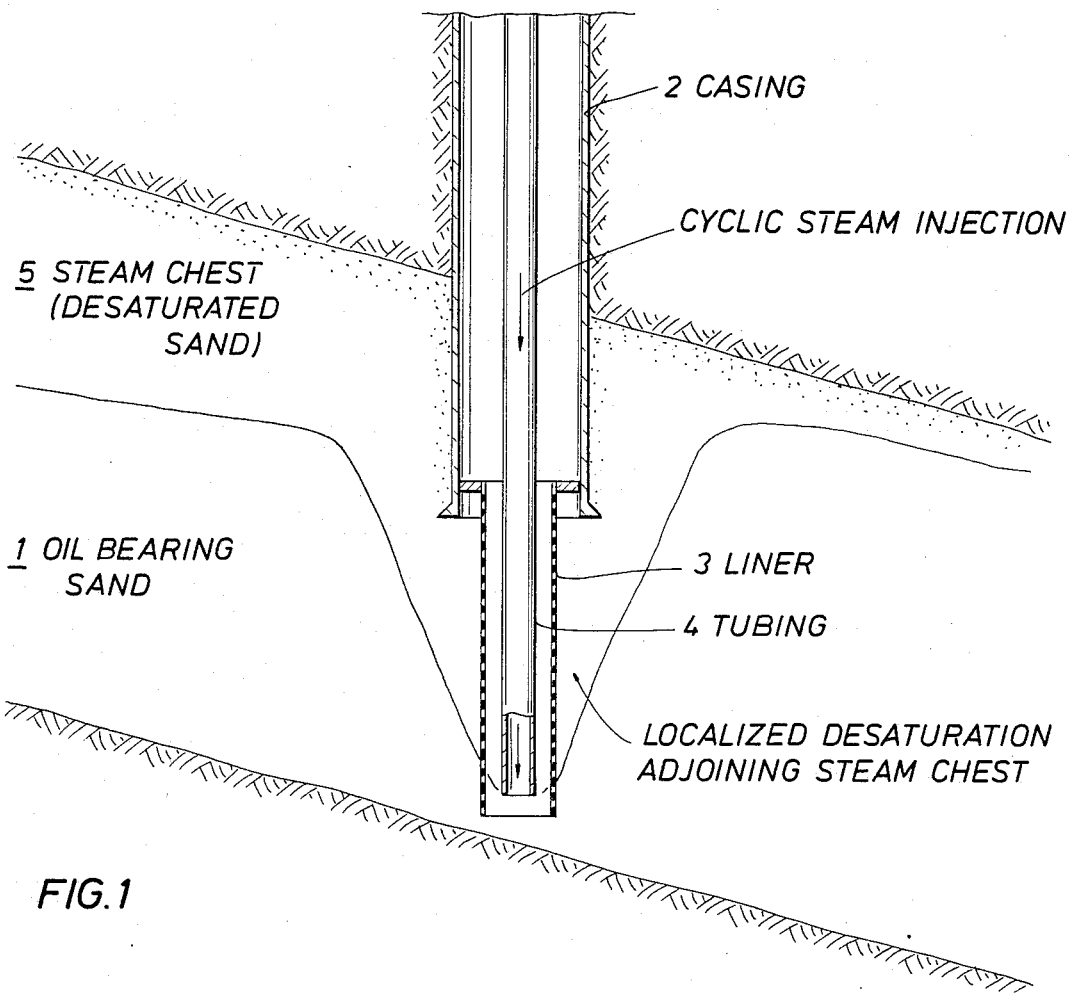
FIG. 1 schematically illustrates a reservoir situation to which the invention is applicable.

It is known that when steam is injected into a heavy oil reservoir which is susceptible to gravity override the reservoir rocks immediately adjacent to a steam soak well tend to become heated to substantially steam temperature and the injected steam tends to rise almost directly upward before moving radially outward. This forms a steam-containing zone having the general form of an inverted cone, which zone becomes more and more voluminous and oil-desaturated along the top of the reservoir. When a substantial proportion of the oil initially present in such a cone shaped zone has been produced, the effective permeability to steam is increased so that when more steam is injected, it tends to preferentially flow upward into the upper portion of the cone-shaped zone within the reservoir. Within that zone the steam tends to condense (and thus lose pressure) more rapidly along the cooler outer edges of the increasingly oil-free cone-shaped zone. When fluid is backflowed from the reservoir, it tends to leave a steam-filled central portion in the cone-shaped zone, within which the permeability to steam has been increased relative to that near the outer edges of the coneshaped zone. In addition, since the condensation of the steam tends to cause the pressure within the oil-desaturated zone to decrease, gravity drainage becomes the main mechanism for displacing oil into the well.

The present invention is, at least in part, premised on a discovery that it is feasible to arrange surfactant components which are mixed with steam so that the steam foam formed within the reservoir formation has a chemical selectivity relative to where it flows and where it is, and where it remains, the least mobile. In the present process, the surfactant component which is mixed with the steam preferably includes at least one each of a noncondensable gas, an aqueous solution of monovalent cation salt, and at least one surfactant capable of forming a steam foam having a relatively low mobility within a sand pack containing the reservoir oil. The kinds and amounts of the foamforming components are arranged relative to the quality of the steam with which they are mixed so that the mixture is capable of forming a steam foam which is both less mobile in sand containing no reservoir oil than steam of the same quality and is also significantly less mobile in sand which is free of the reservoir oil than in sand which contains the reservoir oil.

Such a "chemical selectivity" is mainly responsive to the proportions of the surfactant, water, electrolytes and noncondensible gas which are mixed with the steam. It is also responsive to the interaction between the reservoir oil and the components of the steam-foam-forming mixture, as well as, at least to some extent, being responsive to the chemical composition of the surface active components in that mixture. For example, a change in the kind or amount of either the electrolytes or the surfactant may cause more change in the mobility of the steam foam in sand containing the reservoir oil than in sand substantially free of that oil. An important aspect of the present chemical selectivity is its capability of causing a weakening or collapsing of the flow resistance of hot steam foam when that foam contacts significant proportions of the reservoir oil before there has been any significant collapsing of the steam which forms the gas-phase of that foam.

When such a chemically selective steam-containing fluid is injected into the reservoir, the injection pressure can be kept relatively high while keeping the rate of inflow relatively low. The high injection pressure tends to increase the temperature of the injected steam and the slow rate of injection and flow in the reservoir tends to enhance both the mobility increase due to the chemical-weakening of the foam near the oil-containing edges of the oil-desaturated zone and the tendency for the so-weakened foam to run ahead of the portion of foam which is moving through the central portion of the oil-desaturated zone.

In general, the surfactant components which are mixed with the steam to be injected can be surfactant components of the type described in U.S. Pat. Nos. 4,086,964; 4,161,217; and 4,393,937. The disclosures of these patents are incorporated herein by reference. The suitability of a particular arrangement of the surfactant components to be used in a particular steam and reservoir can readily be determined by measurements of the permeability reduction factor in the manners described in those patents and in the present application.

FIG. 1 shows a typical steam soak well situation in a West Coast heavy oil reservoir. In such reservoirs the sands are relatively homogeneous and have thickness in the order of 75 to 400 feet and are generally free of shales or other strata capable of restricting the vertical migration of oil or steam. As shown, an oil bearing sand 1 is penetrated by a well containing casing 2, perforated liner 3 and tubing string 4, for cyclic steam injection. At the stage shown preceding cycles of injecting and backflowing steam have formed a steam chest 5 of substantially desaturated sand. The desaturated zone is a substantially oil-free generally cone-shaped zone which tends to accept a large proportion of the injected steam and subsequently becomes depressurized (during a soak period) so that the main mechanism for oil production is a gravity drainage aided by little or no pressure gradient from the reservoir to the wellbore.

Figure 2:
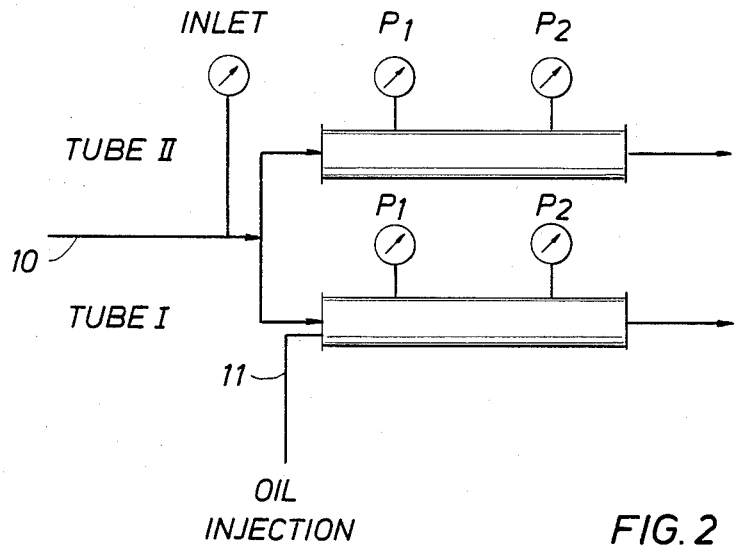
FIG. 2 schematically illustrates a test apparatus.

FIG. 2 schematically illustrates an apparatus for measuring the capability of a given steam-foam-forming mixture for both reducing the mobility of steam injected into a permeable medium containing a particular crude oil and exhibiting a chemical-selectivity such that the foam it forms is significantly more mobil in an oil-containing portion of permeable medium than in an oil-free portion of that medium. The apparatus consists essentially of a pair of matched sand packs or corecontaining tubes filled with portions of permeable earth formations having substantially equal permeabilities. The tubes I and II are mounted horizontally and provided with an injection flowline 10 which is manifolded to provide parallel flow paths through the tubes. Each of the tubes is provided with pressure taps, designated as an Inlet tap, Pl tap and P2 tap, for measuring the pressures at the inlet and at two similarly spaced points within the tubes. Tube I is also provided with an oil injection line 11.

The properties of the sand pack tubes are described in Table 1.

TABLE 1

Properties of Sand-Packed Tubes I and II

| | TUBE I | | TUBE II |
|---|---|---|---|
| POROSITY | 34.2% | | 34.1% |
| PORE VOLUME | 126. ml | | 125. ml |
| BRINE PUMP RATE | 0.72 ml/mn | | 0.72 ml/mn |
| SURFACTANT PUMP RATE | 0.73 ml/mn | | 0.71 ml/mn |
| WATER PUMP RATE | | 2.79 ml/mn | |
| BRINE CONCENTRATION | 6.0% | | 6.0% |
| SURFACTANT | 1.0% | Siponate | A168 |
| INITIAL NITROGEN INJECTION RATE | | 12 ml/mn | |
| INITIAL NITROGEN/STEAM | | 0.003 | |
| INITIAL TEMPERATURE | | 244° F. | |
| INIIIAL PRESSURE | | 12.5 psig | |
| STEAM QUALITY | | 50% | |
| PERMEABILITY: | | | |
| TO SUPERHEATED STEAM | 4.58D | | 5.24D |
| TO STEAM WITH RESIDUAL OIL PRESENT | 0.932D | | 0.834D* |
| TO STEAM WITH FOAM PRESENT ($x_F$) | 0.043D | | 0.029D |
| REDUCTION FACTOR ($K_F/K_{SOR}$) | 0.046 | | 0.035 |
| CONDITIONS EXISTING AT ($K_F$): | | | |

TABLE 1-continued

| Properties of Sand-Packed Tubes I and II | | |
|---|---|---|
| | TUBE I | TUBE II |
| NITROGEN/STEAM | 0.004 | |
| TEMPERATURE | 353° F. | |
| PRESSURE | 125 psig | |
| STEAM QUALITY | 42% | |

*No oil present.

Figure 3:
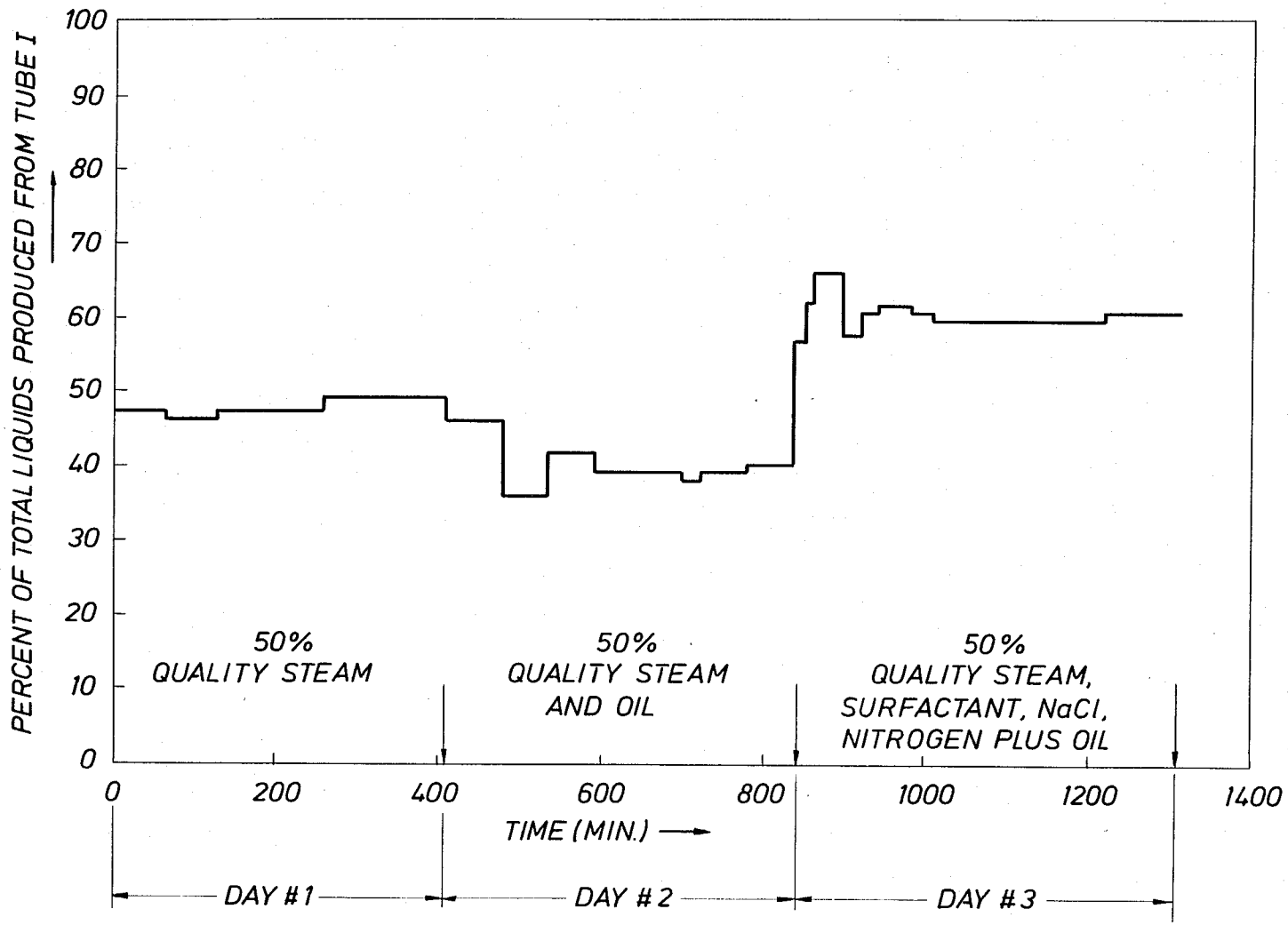
FIG. 3 shows a graph of the percentages of injected fluids which flowed through tube I of the apparatus of FIG. 2.

The measurements of the chemical selectivity of the steam-foam-forming mixture were conducted in accordance with the following schedule. Day #1— inject 50% quality steam only through flowline 10 to show even split of the steam between Tubes I and II. No oil is present in either tube during this operation. See first day portion of FIG. 3. Day #2— continue injecting 50% quality steam into flowline 10 but now also inject oil into Tube I via lie 11. Tube II now is taking the majority of the steam (due to relative permeability effect caused by oil injection into Tube I). See second day portion of FIG. 3. Day #3— inject 50% quality steam through flowline 10, substantially as steam foam. Continue oil injection into Tube I. The steam now preferentially enters Tube I due to the debilitating effect of crude oil on steam foam. The steam foam is "strongest" (i.e., causing less flow) in Tube II. See third day portion of FIG. 3.

Figure 4:
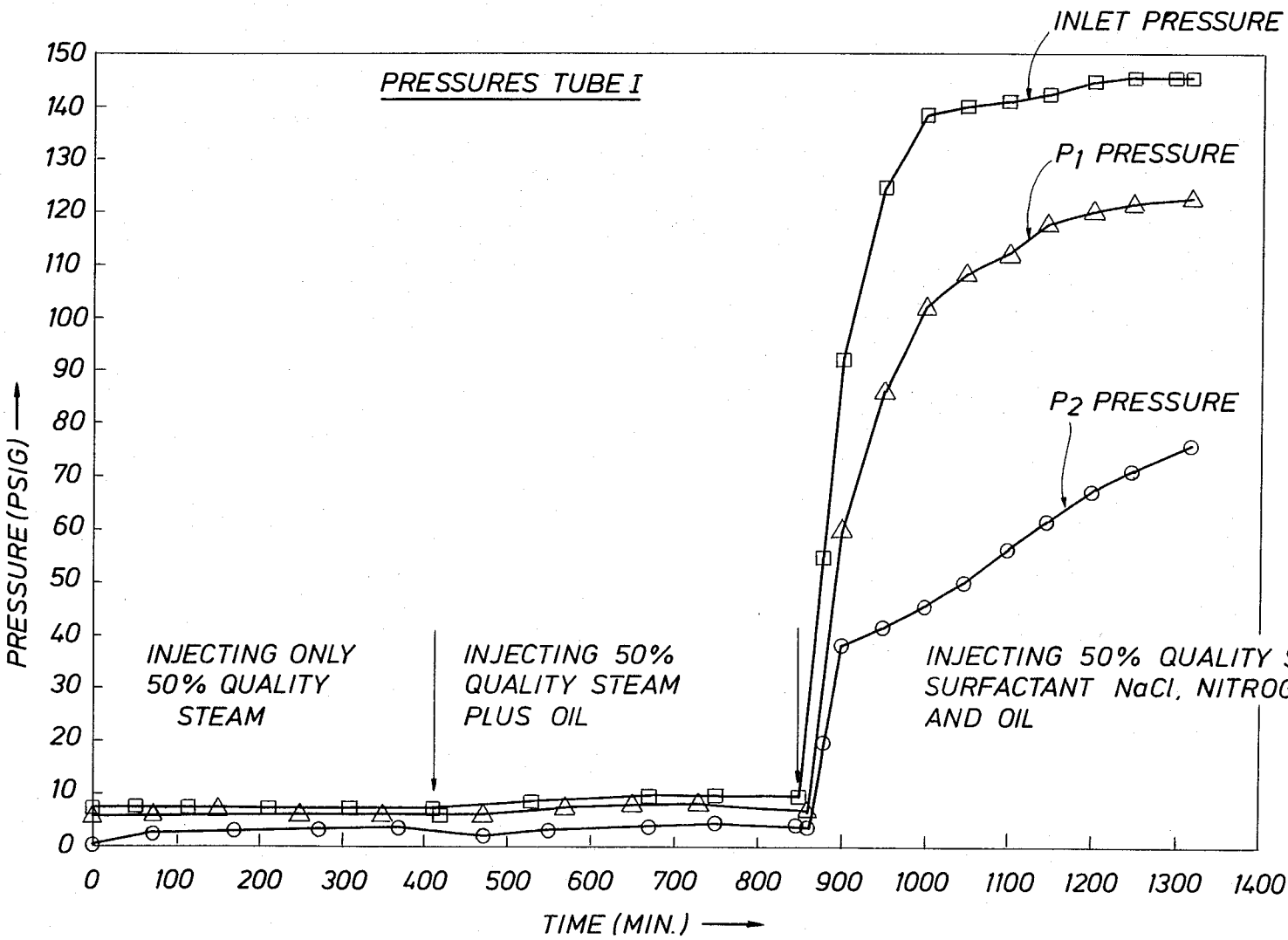
FIGS. 4 and 5 show graphs of pressures with time measured in the apparatus of FIG. 2.
Figure 5:
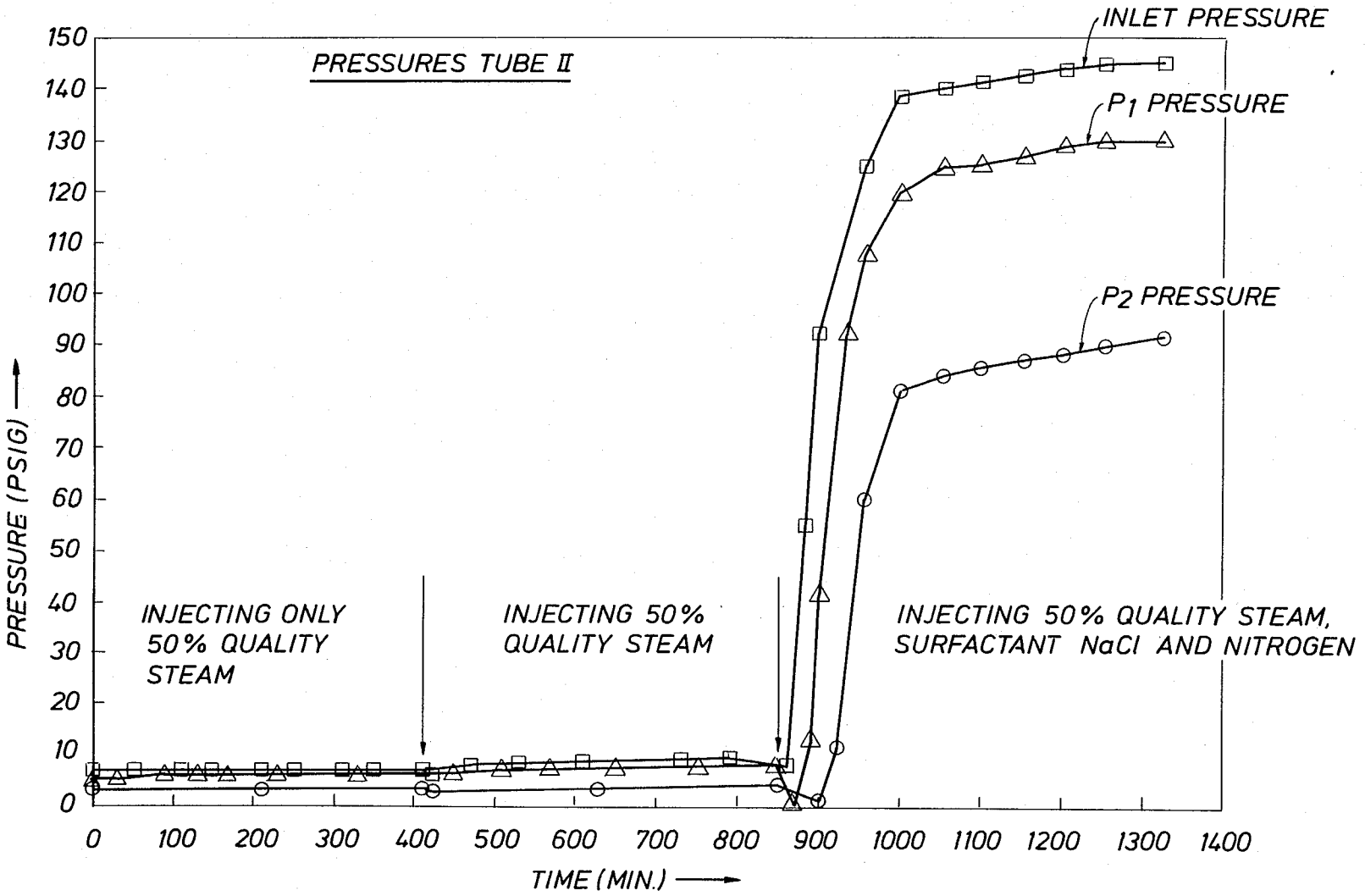
Figure 6:
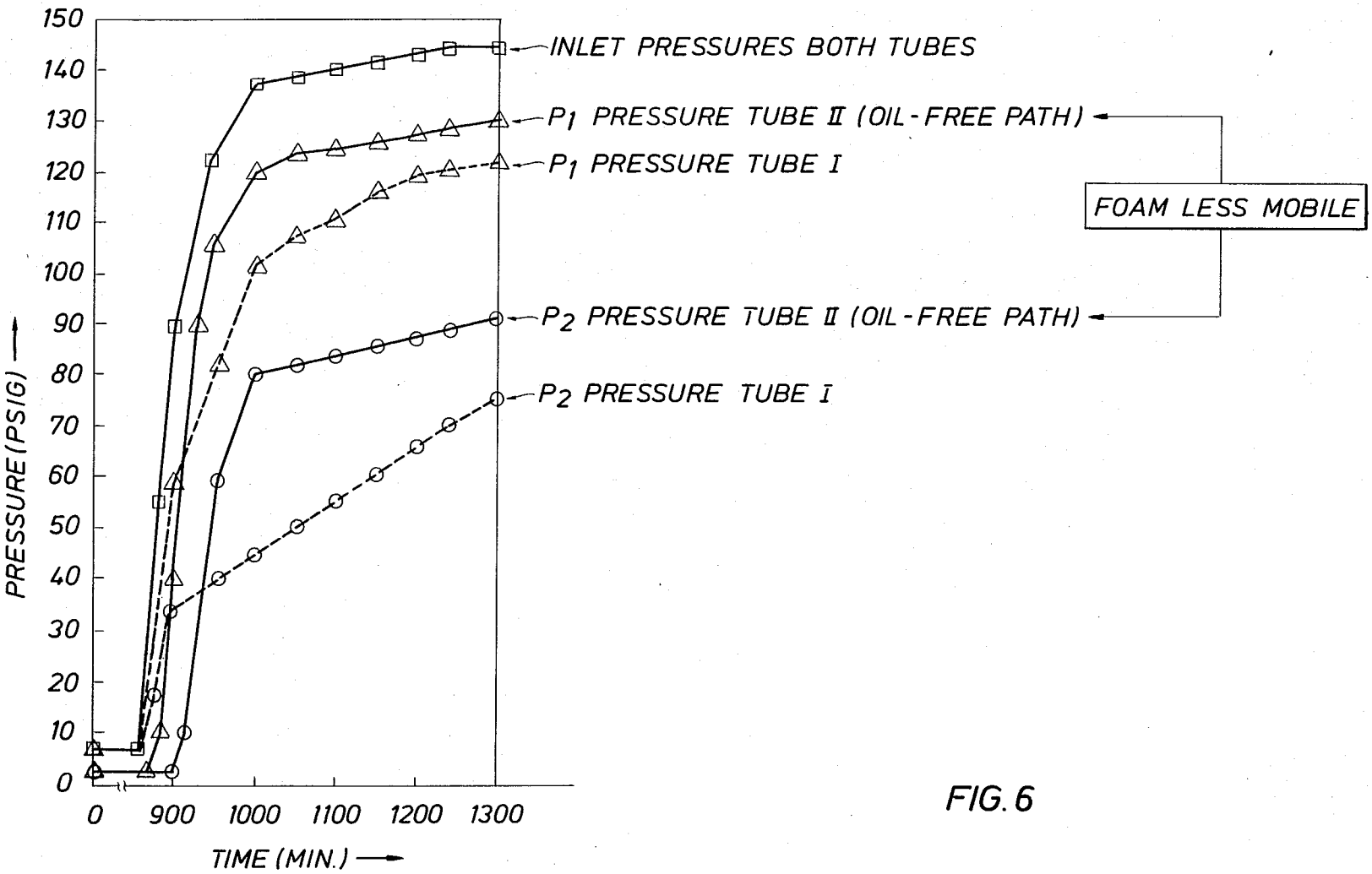
FIG. 6 shows an overlay of portions of the graphs of FIGS. 4 and 5.

FIGS. 4, 5, and 6 show graphs of: (A) sequential injections through tube I of 50% quality steam, that steam mixed with oil, and that steam and oil mixed with surfactant, sodium chloride and nitrogen, and (B) simultaneous and parallel injections through tube II, of 50% quality steam and, subsequently, that steam mixed with surfactant, sodium chloride, and nitrogen. Those injections were conducted with the apparatus mounted within a constant temperature oven maintained at a temperature of 210° F. At the end of each of the three one-day injection periods, the pumps were stopped and the system was shut in while being maintained at the oven temperature until the next day's operation.

During the first day operation, only 50% quality steam was injected into both tubes. As shown in FIGS. 4 and 5, the pressures in all three pressure taps associated with each tube remained substantially equal and constant. This illustrates the known dependency for the mobility of steam to be substantially equal in earth formations which are either free of oil, or which contain oil at a steam residual saturation of oil.

During the second day operation, the 50% quality steam plus a stream of reservoir oil was injected into Tube I while the same quality steam, without any oil, was injected into Tube II. The steam preferentially entered Tube II because of the oil-injection-induced relative permeability effects in Tube I. See second day portion of FIG. 3.

During the third day, a steam-foam-forming mixture of 50% quality steam, surfactant, sodium chloride and nitrogen, was injected into both tubes while oil was injected into tube I. As most clearly portrayed in FIG. 6, which is an overlay of the third day pressure performances in both tubes, significant differences were provided at the internal taps P1 and P2 in each of the tubes. In the oil free path through tube II, the pressures of both taps P1 and P2 were signficantly higher than those taps P1 and P2 of Tube I in which oil was present. This is also reflected in flows from the Tubes—Tube 1 is now receiving the majority of the steam. See the third day portion of FIG. 3.

As indicated in Table 1, the "permeability reduction factor" of the steam-foam-forming mixture in Tube I was 0.046 while that factor in Tube II was 0.035. The "permeability reduction factor" relates to the ratio of the effective mobility (or permeability) of steam by itself to that of steam containing a foam-forming surfactant component, relative to flowing through a permeable medium. Where the permeability reduction factor is smaller it indicates the foam is stronger and results in a greater reduction in mobility. The procedures for calculating such permeability reduction factors are described in greater detail in U.S. Pat. No. 4,393,937.

In the present tests in which both oil-free and an oil-containing paths are parallel (while the temperature and inlet injection pressure are substantially equal) the chemical-selectivity of the foamforming mixture in contact with a particular reservoir crude is clearly demonstrated. The higher pressure required to displace the steam-foam through the oil-free path, the permeability reduction factor exhibited in that path and the fact that the volume of fluid which flows through that path (after subtracting the amount of oil injected into Tube I) was about 60% smaller than the amount which flowed through Tube I show that.

The procedure described above provides a method for determining (or confirming) the chemical selectivity for a preferred path to follow of a given mixture of steam and steam-foam-forming components relative to a permeable reservoir or medium containing a particular crude oil. A pair of fluid conduits are arranged for conducting parallel flows of fluid through actual or simulated permeable earth formations of substantially the same composition and permeability. Steam is initially injected into the conduits and, to the extent required, the arrangement is adjusted to obtain an even split of the steam between the two conduits. Steam is flowed through the conduits at a selected rate while the reservoir oil or an equivalent oil is being flowed through one of the conduits. A mixture of steam and steam-foam-forming components are flowed, along with the same oil, through the same system. A determination is then made of the relative mobility of the mixture of steam and steam-foam-forming components within the respective oil-free and oil-containing conduits in order to determine the chemical-selectivity of that mixture for an oil-free or oil-containing path to follow within a permeable porous medium.

In a reservoir such as that illustrated in FIG. 1, the injection through tubing 4 of a mixture of steam and steam-foam-forming components having good chemical-selectivity will cause the inflowing mixture to be more mobile in the oil-containing portions of area 1 than the more nearly oil-free portions of the steam chest 5.

In general the present invention is applicable to substantially any heavy oil reservoir in which the susceptibility to gravity override has caused or made substantially imminent the creation of a significantly large oil-desaturated zone which has the general shape of an inverted cone and tends to become gas or vapor filled to the extent that it tends to intake and retain significant proportions of the injected steam. Reservoirs like those in the Midway Sunset field are typical and often contain significant proportions of air in oil above the upper portion of an oil layer. In such reservoirs, after injecting in the order of 10–15 thousand barrels of steam and allowing a 1–2 week soak time, during a backflow production cycle to reservoir pressure is often quickly reduced to the order of 50 psig or less. In such reservoirs, the present steam-foam-forming mixture is preferably injected at a relatively low point within the cone-shaped desaturated zone so that its relatively hot, highly pressurized steam contacts the oil-rich lateral edges of the oil desaturated zone and the foam is chemically weakened and selectively mobilized in those locations.

The steam used in the present process can be generated and supplied in the form of substantially any dry, wet, superheated, or low grade steam in which the steam condensate and/or liquid components are compatible with, and do not inhibit, the foam-forming properties of the foam-forming components of a steam-foam-forming mixture of the present invention. It is preferable that the steam quality of the steam as generated and/or amount of aqueous liquid with which it is mixed be such that the steam quality of the resulting mixture is from about 10 to 90%, and more preferably, from about 30 to 80%. In this regard, the desired steam-foam is advantageously prepared by mixing the steam with aqueous solution(s) of the surfactant component and optionally, an electrolyte. The water content of these aqueous solutions must, of course, be taken into account in determining the steam quality of the mixture being formed.

In general, the noncondensable gas used in a steam-foam-forming mixture of the present invention can comprise substantially any gas which (a) undergoes little or no condensation at the temperatures and pressures at which the steam-foam-forming mixture in injected into and displaced through the reservoir to be treated and (b) is substantially inert to and compatible with the foam-forming surfactant and other components of that mixture. Such a gas is preferably nitrogen but can comprise other substantially inert gases, such as air, ethane, methane, flue gas, fuel gas, or the like. Preferred concentrations of noncondensable gas in the steam-foam mixture fall in the range of from about 0.0003 to 0.3 mole percent of the gas phase of the mixture. Concentrations of between about 0.001 and 0.2 mole percent are more preferred and concentrations between about 0.003 and 0.1 mole percent are considered most preferred.

In general, the electrolyte used should have a composition similar to and should be used in a proportion similar tho those described as suitable alkali metal salt electrolytes in the U.S. Pat. No. 4,086,964. The use of an aqueous solution containing an amount of electrolyte substantially equivalent in salting-out effect to a sodium chloride concentration of from about 0.1 to 5% (but less than enough to cause significant salting out) of the liquid phase of the steam is preferred.

As expressed in the U.S. Pat. No. 4,086,964, the presence in the steam-foam-forming mixture of an electrolyte substantially enhances the formation of a foam characterized by a high degree of mobility reduction and a low interfacial tension. Some or all of the electrolyte can comprise an inorganic salt, preferably an alkali metal salt, more preferably an alkali metal halide, and most preferably sodium chloride.

Preference may be generally stated for an electrolyte concentration which has approximately the same effect on mobility reduction of the foam as does a sodium chloride concentration of between about 0.1 and 5 percent by weight (but less than a salting out-inducing proportion) of the liquid phase of the steam-foam-forming mixture. More preferably, the electrolyte concentration is between 0.1 and 5 percent, calculated on the same basis. Most preferably, the liquid phase of the steam-foam-forming mixture contains between about 1 and 4 percent by weight electrolyte. Further preference may generally be stated, in steam-foam compositions which contain electrolyte, for a weight ratio of electrolyte to surfactant which is in the range of from about 0.5 to 6; more preferably this ratio is in the range of from about 1 to 4.

In compounding a steam-foam-forming mixture in accordance with the present invention, the steam can be generated by means of substantially any of the commercially available devices and techniques for steam generation. A stream of steam being injected into a reservoir is preferably generated and mixed, in substantially any surface or downhole location, with selected proportions of substantially noncondensable gas, aqueous electrolyte solution, and foam-forming surfactant. For example, in such a mixture, the quality of the steam which is generated and the concentration of the electrolyte and surfactant-containing aqueous liquid with which it is mixed are preferably arranged so that (1) the proportion of aqueous liquid mixed with the dry steam which is injected into the reservoir is sufficient to provide a steam-containing fluid having a steam quality of from about 10–90% (and preferably from about 30–80%); (2) the weight proportion of surfactant dissolved or dispersed in that aqueous liquid is from about 0.01 to 5.0 (and preferably from about 1.0 to 4.0); and (4) the amount of noncondensable gas is from about 0.0003 to 0.3 mole fraction of the gas-phase of the mixture.

It will be observed, in this regard, that either or both of the optional electrolyte and noncondensable gas components might be, to some extent, supplied by the reservoir itself and thus the total supply thereof by surface facilities may not be necessary to the formation of steam-foams in which they are present. However, for best control over steam-foam composition and drive process performance, substantially all of each of the desired components of the steam-foam-forming mixture are injected along with the steam. Devices suitable for the mixing and injecting of steam-foam-forming mixtures for purposes of this invention are known to the art and commercially available.

In general, the steam can be suitably mixed with the noncondensable gas, electrolyte, and surfactant upstream of the reservoir, with or without a mixing and/or foam-forming device. The devices and techniques by which this is effected can comprise substantially any of those which are currently commercially available.

What is claimd is:

1. In an oil recovery process in which steam mixed with steam-foam-forming components is injected into a substerranean reservoir that contains a heavy oil and is susceptible to gravity override and, after a soak period, fluid is backflowed for production from the reservoir, an improvement which comprises:

mixing the steam injected into the reservoir with at least one each of noncondensible gas, monovalent cation salt and surfactant;

arranging the chemical compositions and proportions of the components mixed with the steam relative to both the quality of the steam and the chemical composition of the reservoir oil so that the foam formed by the mixture is significantly chemically weakened by contact with the reservoir oil; and injecting the so-arranged mixture of steam and steam-foam-forming components and producing the fluid backflowed from the reservoir at rates and pressures such that the steam foam located within a zone of the reservoir in which the foam contacts a significant proportion of oil, tends to become chemically weakened and more mobile before the condensing of the steam from the gaseous component of the steam foam has become significant.

2. The process of claim 1 in which the surfactant consists essentially of an alpha-olefin surfactant.

3. The process of claim 1 in which the reservoir is one in which the formation, around the well, of a desaturated zone having the general shape of an inverted cone is at least substantially imminent.

4. The process of claim 3 in which the mixture of steam and steam forming compounds is injected at a location which is relatively low within the cone-shaped desaturated zone.

* * * * *